US009994942B2

(12) United States Patent
Kawano et al.

(10) Patent No.: US 9,994,942 B2
(45) Date of Patent: Jun. 12, 2018

(54) STEEL MATERIAL

(71) Applicant: NIPPON STEEL & SUMITOMO METAL CORPORATION, Tokyo (JP)

(72) Inventors: Kaori Kawano, Tokyo (JP); Yasuaki Tanaka, Tokyo (JP); Masahito Tasaka, Tokyo (JP); Yoshiaki Nakazawa, Tokyo (JP); Toshiro Tomida, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 184 days.

(21) Appl. No.: 14/400,301

(22) PCT Filed: Aug. 21, 2013

(86) PCT No.: PCT/JP2013/072262

§ 371 (c)(1),
(2) Date: Nov. 10, 2014

(87) PCT Pub. No.: WO2014/030663

PCT Pub. Date: Feb. 27, 2014

(65) Prior Publication Data

US 2015/0098857 A1 Apr. 9, 2015

(30) Foreign Application Priority Data

Aug. 21, 2012 (JP) ..... 2012-182710

(51) Int. Cl.

| | |
|---|---|
| ***C22C 38/38*** | (2006.01) |
| ***C22C 38/14*** | (2006.01) |
| ***C22C 38/28*** | (2006.01) |
| ***C22C 38/00*** | (2006.01) |
| ***C22C 38/04*** | (2006.01) |
| ***C22C 38/06*** | (2006.01) |
| ***C22C 38/12*** | (2006.01) |
| ***C22C 38/18*** | (2006.01) |
| ***C22C 38/22*** | (2006.01) |
| ***C22C 38/24*** | (2006.01) |
| ***C21D 8/02*** | (2006.01) |
| ***C21D 1/20*** | (2006.01) |
| ***H01F 1/16*** | (2006.01) |
| ***C22C 38/02*** | (2006.01) |

(52) U.S. Cl.

CPC ..... *C22C 38/38* (2013.01); *C21D 1/20* (2013.01); *C21D 8/0226* (2013.01); *C21D 8/0273* (2013.01); *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C22C 38/22* (2013.01); *C22C 38/24* (2013.01); *C22C 38/28* (2013.01); *H01F 1/16* (2013.01); *C21D 2211/002* (2013.01); *C21D 2211/005* (2013.01); *C21D 2211/008* (2013.01)

(58) Field of Classification Search

CPC ..... C22C 38/02; C22C 38/04; C22C 38/38; C22C 38/14

USPC ..... 420/120

See application file for complete search history.

(56) References Cited

U.S. PATENT DOCUMENTS

| | | | | |
|---|---|---|---|---|
| 2003/0084966 | A1 | 5/2003 | Ikeda et al. | |
| 2008/0131305 | A1 | 6/2008 | Okitsu | |
| 2009/0252641 | A1* | 10/2009 | Hoshi | C22C 38/12 420/118 |
| 2009/0301613 | A1 | 12/2009 | Koo et al. | |
| 2013/0061989 | A1 | 3/2013 | Nakamura et al. | |

FOREIGN PATENT DOCUMENTS

| | | | |
|---|---|---|---|
| EP | 1 398 390 | A1 | 3/2004 |
| EP | 1 918 403 | A1 | 5/2008 |
| EP | 2 612 945 | A1 | 7/2013 |
| ES | 2 256 378 | T3 | 7/2006 |
| JP | 60-243226 | A | 12/1985 |
| JP | 62-174322 | A | 7/1987 |
| JP | 11-80879 | A | 3/1999 |
| JP | 11-269606 | A | 10/1999 |

(Continued)

OTHER PUBLICATIONS

International Search Report, dated Nov. 19, 2013, issued in PCT/JP2013/072262.
Taiwanese Office Action 102130040 dated Aug. 20, 2014.
Written Opinion of the International Searching Authority, dated Nov. 19, 2013, issued in PCT/JP2013/072262.
Advisory Action issued in U.S. Appl. No. 13/643,696, dated March 23, 2016.

(Continued)

*Primary Examiner* — Weiping Zhu
(74) *Attorney, Agent, or Firm* — Birch, Stewart, Kolasch & Birch, LLP

(57) ABSTRACT

A steel material contains: by mass %, C: greater than 0.05% to 0.18%; Mn: 1% to 3%; Si: greater than 0.5% to 1.8%; Al: 0.01% to 0.5%; N: 0.001% to 0.015%; one or both of V and Ti: 0.01% to 0.3% in total; Cr: 0% to 0.25%; Mo: 0% to 0.35%; a balance: Fe and impurities; and 80% or more of bainite by area %, and 5% or more in total of one or two or more selected from a group consisting of ferrite, martensite and austenite by area %, in which an average block size of the above-described bainite is less than 2.0 μm, an average grain diameter of all of the above-described ferrite, martensite and austenite is less than 1.0 μm, an average nanohardness of the above-described bainite is 4.0 GPa to 5.0 GPa, and MX-type carbides each having a circle-equivalent diameter of 10 nm or more exist with an average grain spacing of 300 nm or less therebetween.

4 Claims, 1 Drawing Sheet

(56) References Cited

FOREIGN PATENT DOCUMENTS

| | | | | |
|---|---|---|---|---|
| JP | 2000-8136 | A | 1/2000 | |
| JP | 2000-17385 | A | 1/2000 | |
| JP | 2000-109951 | A | 4/2000 | |
| JP | 2001-220647 | A | 8/2001 | |
| JP | 2004-84074 | A | 3/2004 | |
| JP | 2004-277858 | A | 10/2004 | |
| JP | 2005-305454 | A | 11/2005 | |
| JP | 2006-161077 | A | 6/2006 | |
| JP | 3958842 | B2 | 5/2007 | |
| JP | 2008-189984 | A | 8/2008 | |
| JP | 2009-84637 | A | 4/2009 | |
| JP | 2012-1773 | A | 1/2012 | |
| JP | 2012-7649 | A | 1/2012 | |
| JP | 2012-12701 | A | 1/2012 | |
| TW | 201226582 | A1 | 7/2012 | |
| WO | WO 2012060405 | A1 * | 5/2012 | ..... C22C 38/02 |

OTHER PUBLICATIONS

Final Office Action issued in U.S. Appl. No. 13/643,696, dated Jan. 8, 2016.

Non-Final Office Action issued in U.S. Appl. No. 13/643,696, dated Jul. 1, 2015.

Non-Final Office Action issued in U.S. Appl. No. 13/643,696, dated Oct. 20, 2016.

* cited by examiner

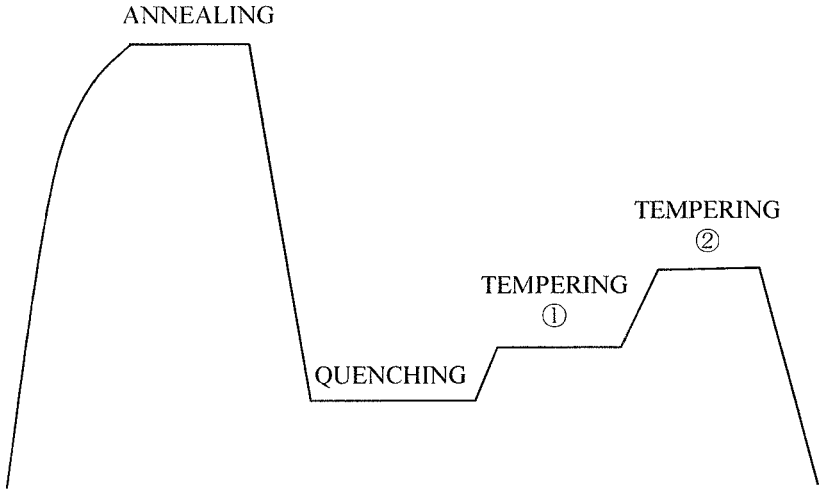
ANNEALING
QUENCHING
TEMPERING
①
TEMPERING
②

STEEL MATERIAL

TECHNICAL FIELD

The present invention relates to a steel material, and concretely relates to a steel material suitable for a material of an impact absorbing member in which an occurrence of crack when applying an impact load is suppressed, and further, an effective flow stress is high. This application is based upon and claims the benefit of priority of the prior Japanese Patent Application No. 2012-182710, filed on Aug. 21, 2012, the entire contents of which are incorporated herein by reference.

BACKGROUND ART

In recent years, from a point of view of global environmental protection, a reduction in weight of a vehicle body of automobile has been required as a part of reduction in $CO_2$ emissions from automobiles, and a high-strengthening of a steel material for automobile has been aimed. This is because, by improving the strength of steel material, it becomes possible to reduce a thickness of the steel material for automobile. Meanwhile, a social need with respect to an improvement of collision safety of automobile has been further increased, and not only the high-strengthening of steel material but also a development of steel material excellent in impact resistance when a collision occurs during traveling, has been desired.

Here, respective portions of a steel material for automobile at a time of collision are deformed at a high strain rate of several tens ($s^{-1}$) or more, so that a high-strength steel material excellent in dynamic strength property is required.

As such a high-strength steel material, a low-alloy TRIP steel having a large static-dynamic difference (difference between static strength and dynamic strength), and a high-strength multi-phase structure steel material such as a multi-phase structure steel having a second phase mainly formed of martensite, are known.

Regarding the low-alloy TRIP steel, for example, Patent Document 1 discloses a strain-induced transformation type high-strength steel sheet (TRIP steel sheet) for absorbing collision energy of automobile excellent in dynamic deformation property.

Further, regarding the multi-phase structure steel sheet having the second phase mainly formed of martensite, inventions as will be described below are disclosed.

Patent Document 2 discloses a high-strength steel sheet having an excellent balance of strength and ductility and having a static-dynamic difference of 170 MPa or more, the high-strength steel sheet being formed of fine ferrite grains, in which an average grain diameter ds of nanocrystal grains each having a crystal grain diameter of 1.2 μm or less and an average crystal grain diameter dL of microcrystal grains each having a crystal grain diameter of greater than 1.2 μm satisfy a relation of $dL/ds \geq 3$.

Patent Document 3 discloses a steel sheet formed of a dual-phase structure of martensite whose average grain diameter is 3 μm or less and martensite whose average grain diameter is 5 μm or less, and having a high static-dynamic ratio.

Patent Document 4 discloses a cold-rolled steel sheet excellent in impact absorption property containing 75% or more of ferrite phase in which an average grain diameter is 3.5 μm or less, and a balance composed of tempered martensite.

Patent Document 5 discloses a cold-rolled steel sheet in which a prestrain is applied to produce a dual-phase structure formed of ferrite and martensite, and a static-dynamic difference at a strain rate of $5\times10^2$ to $5\times10^3$/s satisfies 60 MPa or more.

Further, Patent Document 6 discloses a high-strength hot-rolled steel sheet excellent in impact resistance property formed only of hard phase such as bainite of 85% or more and martensite.

PRIOR ART DOCUMENT

Patent Document

Patent Document 1: Japanese Laid-open Patent Publication No. H11-80879

Patent Document 2: Japanese Laid-open Patent Publication No. 2006-161077

Patent Document 3: Japanese Laid-open Patent Publication No. 2004-84074

Patent Document 4: Japanese Laid-open Patent Publication No. 2004-277858

Patent Document 5: Japanese Laid-open Patent Publication No. 2000-17385

Patent Document 6: Japanese Laid-open Patent Publication No. H11-269606

DISCLOSURE OF THE INVENTION

Problems to be Solved by the Invention

However, the conventional steel materials being materials of impact absorbing members have the following problems. Specifically, in order to improve an impact absorption energy of an impact absorbing member (which is also simply referred to as "member", hereinafter), it is essential to increase a strength of a steel material being a material of the impact absorbing member (which is also simply referred to as "steel material", hereinafter).

Incidentally, as disclosed in "Journal of the Japan Society for Technology of Plasticity" vol. 46, No. 534, pages 641 to 645, that an average load ($F_{ave}$) determining an impact absorption energy is given in a manner that $F_{ave} \propto (\sigma Y \cdot t^2)/4$, in which $\sigma Y$ indicates an effective flow stress, and t indicates a sheet thickness, the impact absorption energy greatly depends on the sheet thickness of steel material. Therefore, there is a limitation in realizing both of a reduction in thickness and a high impact absorbency of the impact absorbing member only by increasing the strength of the steel material.

Here, the flow stress corresponds to a stress required for successively causing a plastic deformation at a start or after the start of the plastic deformation, and the effective flow stress means a plastic flow stress which takes a sheet thickness and a shape of the steel material and a rate of strain applied to a member when an impact is applied into consideration.

Meanwhile, for example, as disclosed in pamphlet of International Publication No. WO 2005/010396, pamphlet of International Publication No. WO 2005/010397, and pamphlet of International Publication No. WO 2005/010398, an impact absorption energy of an impact absorbing member also greatly depends on a shape of the member.

Specifically, by optimizing the shape of the impact absorbing member so as to increase a plastic deformation workload, there is a possibility that the impact absorption energy of the impact absorbing member can be dramatically increased to a level which cannot be achieved only by increasing the strength of the steel material.

However, even when the shape of the impact absorbing member is optimized to increase the plastic deformation workload, if the steel material has no deformability capable of enduring the plastic deformation workload, a crack occurs on the impact absorbing member in an early stage before an expected plastic deformation is completed, resulting in that the plastic deformation workload cannot be increased, and it is not possible to dramatically increase the impact absorption energy. Further, the occurrence of crack on the impact absorbing member in the early stage may lead to an unexpected situation such that another member disposed by being adjacent to the impact absorbing member is damaged.

In the conventional techniques, it has been aimed to increase the dynamic strength of the steel material based on a technical idea that the impact absorption energy of the impact absorbing member depends on the dynamic strength of the steel material, but, there is a case where the deformability is significantly lowered only by aiming the increase in the dynamic strength of the steel material. Accordingly, even if the shape of the impact absorbing member is optimized to increase the plastic deformation workload, it was not always possible to dramatically increase the impact absorption energy of the impact absorbing member.

Further, since the shape of the impact absorbing member has been studied on the assumption that the steel material manufactured based on the above-described technical idea is used, the optimization of the shape of the impact absorbing member has been studied, from the first, based on the deformability of the existing steel material as a premise, and thus the study itself such that the deformability of the steel material is increased and the shape of the impact absorbing member is optimized to increase the plastic deformation workload, has not been done sufficiently so far.

The present invention has a task to provide a steel material suitable for a material of an impact absorbing member having a high effective flow stress and thus having a high impact absorption energy and in which an occurrence of crack when an impact load is applied is suppressed, and a manufacturing method thereof.

Means for Solving the Problems

As described above, in order to increase the impact absorption energy of the impact absorbing member, it is important to optimize not only the steel material but also the shape of the impact absorbing member to increase the plastic deformation workload.

Regarding the steel material, it is important to increase the effective flow stress to increase the plastic deformation workload while suppressing the occurrence of crack when the impact load is applied, so that the shape of the impact absorbing member capable of increasing the plastic deformation workload can be optimized.

The present inventors conducted earnest studies regarding a method of suppressing the occurrence of crack when the impact load is applied and increasing the effective flow stress regarding the steel material to increase the impact absorption energy of the impact absorbing member, and obtained new findings as will be cited hereinbelow.

[Improvement of Impact Absorption Energy]

(1) In order to increase the impact absorption energy of the steel material, it is effective to increase the effective flow stress when a true strain of 5% is given (which will be described as "5% flow stress", hereinafter).

(2) In order to increase the 5% flow stress, it is effective to increase a yield strength and a work hardening coefficient in a low-strain region.

(3) In order to increase the yield strength, it is effective to produce a steel structure containing bainite as a main phase.

(4) In order to increase the work hardening coefficient in the low-strain region in the steel material containing bainite as the main phase, it is effective to make fine precipitates exist at a high density.

[Suppression of Occurrence of Crack when Impact Load is Applied]

(5) When a crack occurs on the impact absorbing member at the time of applying the impact load, the impact absorption energy is lowered. Further, there is also a case where another member adjacent to the impact absorbing member is damaged.

(6) When the strength, particularly the yield strength of the steel material is increased, a sensitivity with respect to a crack at the time of applying the impact load (which is also referred to as "impact crack", hereinafter) (the sensitivity is also referred to as "impact crack sensitivity", hereinafter) becomes high.

(7) In order to suppress the occurrence of impact crack, it is effective to increase a uniform ductility, a local ductility and a fracture toughness.

(8) In the steel material containing bainite as the main phase, the ductility can be increased by refining bainite being the main phase.

(9) It is set that the steel material containing bainite as the main phase contains, as a second phase, one or two or more selected from a group consisting of ferrite, martensite and austenite, and if the above elements are refined, the local ductility can be further improved.

(10) In order to increase the fracture toughness in the steel material containing bainite as the main phase, it is effective to produce a structure in which ferrite is contained in the second phase. However, coarse ferrite causes a decrease in the yield stress and a crush load, so that ferrite has to be refined.

(11) In order to increase the uniform ductility in the steel material containing bainite as the main phase, it is effective to produce a structure in which austenite is contained in the second phase. However, coarse austenite exerts an adverse effect on the fracture toughness when being transformed into a martensite phase due to a strain induction, so that austenite has to be refined.

(12) In order to increase the fracture toughness in the steel material containing bainite as the main phase, it is effective to produce a structure in which martensite is contained in the second phase. However, coarse martensite exerts an adverse effect on the fracture toughness, so that martensite has to be refined.

The present invention is made based on the above-described new findings, and a gist thereof is as follows.

[1]

A steel material contains: by mass %, C: greater than 0.05% to 0.18%; Mn: 1% to 3%; Si: greater than 0.5% to 1.8%; Al: 0.01% to 0.5%; N: 0.001% to 0.015%; one or both of V and Ti: 0.01% to 0.3% in total; Cr: 0% to 0.25%; Mo: 0% to 0.35%; a balance: Fe and impurities; and 80% or more of bainite by area %, and 5% or more in total of one or two or more selected from a group consisting of ferrite, martensite and austenite by area %, in which an average block size of the above-described bainite is less than 2.0 μm, an average grain diameter of all of the above-described ferrite, martensite and austenite is less than 1.0 μm, an average nanohardness of the above-described bainite is 4.0 GPa to 5.0 GPa, and MX-type carbides each having a circle-equivalent diameter of 10 nm or more exist with an average grain spacing of 300 nm or less therebetween.

[2]

The steel material according to [1] contains, by mass %, one or two selected from a group consisting of Cr: 0.05% to 0.25%, and Mo: 0.1% to 0.35%.

Effect of the Invention

According to the present invention, it becomes possible to obtain an impact absorbing member capable of suppressing or eliminating an occurrence of crack thereon when an impact load is applied, and having a high effective flow stress, so that it becomes possible to dramatically increase an impact absorption energy of the impact absorbing member. By applying the impact absorbing member as above, it becomes possible to further improve a collision safety of a product of an automobile and the like, which is industrially extremely useful.

BRIEF DESCRIPTION OF THE DRAWINGS

FIG. 1 illustrates a heat pattern in continuous annealing heat treatment employed in an example.

MODE FOR CARRYING OUT THE INVENTION

Hereinafter, the present invention will be described in detail. In the following description, % related to a chemical composition of steel indicates mass %.

1. Chemical Composition

Note that "%" in the following description regarding the chemical composition means "mass %", unless otherwise noted.

(1) C: Greater than 0.05% to 0.18%

C has a function of facilitating a generation of bainite being a main phase, and austenite being a second phase, a function of improving a yield strength and a tensile strength by increasing a strength of the second phase, and a function of improving the yield strength and the tensile strength by strengthening a steel through solid-solution strengthening. Further, C has a function of coupling with Ti and V to precipitate MX-type fine carbides, and improving the yield strength and a work hardening coefficient in a low-strain region. If a C content is 0.05% or less, it is sometimes difficult to achieve an effect provided by the above-described functions. Therefore, the C content is set to be greater than 0.05%. On the other hand, if the C content exceeds 0.18%, there is a case where martensite and austenite are excessively generated, which sometimes facilitates the occurrence of crack at the time of applying the impact load. Therefore, the C content is set to 0.18% or less. The C content is preferably 0.15% or less, and is more preferably 0.13% or less. Note that the present invention includes a case where the C content is 0.18%.

(2) Mn: 1% to 3%

Mn has a function of facilitating a generation of bainite by increasing a hardenability, and a function of improving the yield strength and the tensile strength by strengthening the steel through solid-solution strengthening. If a Mn content is less than 1%, it is sometimes difficult to achieve an effect provided by the above-described functions. Therefore, the Mn content is set to 1% or more. The Mn content is preferably 1.5% or more. On the other hand, if the Mn content exceeds 3%, there is a case where martensite and austenite are excessively generated, resulting in that the local ductility is significantly lowered. Therefore, the Mn content is set to 3% or less. The Mn content is preferably 2.5% or less. Note that the present invention includes a case where the Mn content is 1% and a case where the Mn content is 3%.

(3) Si: Greater than 0.5% to 1.8%

Si has a function of improving a uniform ductility and the local ductility by suppressing a generation of carbide in bainite and martensite, and a function of improving the yield strength and the tensile strength by strengthening the steel through solid-solution strengthening. If a Si content is 0.5% or less, it is sometimes difficult to achieve an effect provided by the above-described functions. Therefore, the Si amount is set to be greater than 0.5%. The Si amount is preferably 0.8% or more, and is more preferably 1% or more. On the other hand, if the Si content exceeds 1.8%, there is a case where austenite excessively remains, and the impact crack sensitivity becomes significantly high. Therefore, the Si content is set to 1.8% or less. The Si content is preferably 1.5% or less, and is more preferably 1.3% or less. Note that the present invention includes a case where the Si content is 1.8%.

(4) Al: 0.01% to 0.5%

Al has a function of suppressing a generation of inclusion in a steel through deoxidation, and preventing the impact crack. If an Al content is less than 0.01%, it is difficult to achieve an effect provided by the above-described function. Therefore, the Al content is set to 0.01% or more. On the other hand, if the Al content exceeds 0.5%, an oxide and a nitride become coarse, which facilitates the impact crack, instead of preventing the impact crack. Therefore, the Al content is set to 0.5% or less. Note that the present invention includes a case where the Al content is 0.01% and a case where the Al content is 0.5%.

(5) N: 0.001% to 0.015%

N has a function of suppressing a grain growth of austenite and ferrite by generating a nitride, and suppressing the impact crack by refining a structure. If a N content is less than 0.001%, it is difficult to achieve an effect provided by the above-described function. Therefore, the N content is set to 0.001% or more. On the other hand, if the N content exceeds 0.015%, a nitride becomes coarse, which facilitates the impact crack, instead of suppressing the impact crack. Therefore, the N content is set to 0.015% or less. Note that the present invention includes a case where the N content is 0.001% and a case where the N content is 0.015%.

(6) One or Both of V and Ti: 0.01% to 0.3% in Total

V and Ti have a function of generating carbides such as VC and TiC in the steel, suppressing a growth of coarse crystal grains through a pinning effect with respect to a grain growth of ferrite, and suppressing the impact crack. Further, V and Ti have a function of improving the yield strength and the tensile strength by strengthening the steel through precipitation strengthening realized by VC and TiC. Therefore, one or both of V and Ti is (are) contained. If a total content of V and Ti (also referred to as "(V+Ti) content", hereinafter) is less than 0.01%, it is difficult to achieve an effect provided by the above-described functions. Therefore, the (V+Ti) content is set to 0.01% or more. On the other hand, if the (V+Ti) content exceeds 0.3%, VC or TiC is excessively generated, which increases the impact crack sensitivity, instead of lowering the impact crack sensitivity. Therefore, the (V+Ti) content is set to 0.3% or less. The present invention includes a case where the total content of V and Ti is 0.01% and a case where the total content is 0.3%. Any one of a case where only V is contained in an amount of 0.01% to 0.3%, a case where only Ti is contained in an amount of 0.01% to 0.3%, and a case where both of V and Ti are contained in an amount of 0.01% to 0.3% in total, may be employed.

Further, it is also possible that one or two of Cr and Mo is (are) contained as an optionally contained element.

(7) Cr: 0% to 0.25%

Cr is an optionally contained element, and has a function of increasing a hardenability to facilitate a generation of bainite, and a function of improving the yield strength and the tensile strength by strengthening the steel through solid-solution strengthening. In order to more securely achieve these functions, a content of Cr is preferably 0.05% or more. However, if the Cr content exceeds 0.25%, a martensite phase is excessively generated, which increases the impact crack sensitivity. Therefore, the Cr content is set to 0.25% or less. Note that the present invention includes a case where the content of Cr is 0.25%.

(8) Mo: 0% to 0.35%

Mo is, similar to Cr, an optionally contained element, and has a function of increasing the hardenability to facilitate a generation of bainite and martensite, and a function of improving the yield strength and the tensile strength by strengthening the steel through solid-solution strengthening. In order to more securely achieve these functions, a content of Mo is preferably 0.1% or more. However, if the Mo content exceeds 0.35%, the martensite phase is excessively generated, which increases the impact crack sensitivity. Therefore, when Mo is contained, the content of Mo is set to 0.35% or less. Note that the present invention includes a case where the content of Mo is 0.35%.

The steel material of the present invention contains the above-described essential contained elements, further contains the optionally contained elements according to need, and contains a balance composed of Fe and impurities. As the impurity, one contained in a raw material of ore, scrap and the like, and one contained in a manufacturing step can be exemplified. However, it is allowable that the other components are contained within a range in which the properties of steel material intended to be obtained in the present invention are not inhibited. For example, although P and S are contained in the steel as impurities, P and S are desirably limited in the following manner.

P: 0.02% or Less

P makes a grain boundary to be fragile, and deteriorates a hot workability. Therefore, an upper limit of P content is set to 0.02% or less. It is desirable that the P content is as small as possible, but, based on the assumption that a dephosphorization is performed within a range of actual manufacturing steps and manufacturing cost, the upper limit of P content is 0.02%. The upper limit is desirably 0.015% or less.

S: 0.005% or Less

S makes the grain boundary to be fragile, and deteriorates the hot workability and ductility. Therefore, an upper limit of P content is set to 0.005% or less. It is desirable that the S content is as small as possible, but, based on the assumption that a desulfurization is performed within a range of actual manufacturing steps and manufacturing cost, the upper limit of S content is 0.005%. The upper limit is desirably 0.002% or less.

2. Steel Structure

A steel structure related to the present invention contains bainite with fine block size as a main phase, and further, it improves the plastic flow stress with the use of fine precipitates, in order to realize both of an increase in effective flow stress by obtaining a high yield strength and a high work hardening coefficient in the low-strain region, and an impact crack resistance.

(1) Area Ratio of Bainite: 80% or More

If an area ratio of bainite being the main phase is less than 80%, it becomes difficult to secure a high yield strength. Therefore, the area ratio of bainite being the main phase is set to 80% or more. The area ratio of bainite is preferably 85% or more, and is more preferably greater than 90%.

(2) Average Block Size of Bainite: Less than 2.0 μm

The ductility can be increased by refining bainite being the main phase. If an average block size of bainite is 2.0 μm or more, it is difficult to improve the ductility. Therefore, the average block size of bainite is set to less than 2.0 μm. This block size is preferably 1.5 μm or less.

(3) One or two or more selected from a group consisting of ferrite, martensite and austenite is (are) contained in an amount of 5% or more in total, and an average grain diameter of all of the above-described ferrite, martensite and bainite is less than 1.0 μm.

If it is set that in the steel material containing bainite as the main phase, a second phase thereof contains one or two or more selected from a group consisting of ferrite, martensite and austenite, and these elements are refined, the local ductility can be further improved. If a total area ratio of ferrite, martensite and austenite is less than 5%, or if an average grain diameter of all of ferrite, martensite and austenite is 1.0 μm or more, it is difficult to further improve the local ductility. Therefore, it is set that one or two or more selected from a group consisting of ferrite, martensite and austenite is (are) contained in an amount of 5% or more in total, and the average grain diameter of all of the above-described ferrite, martensite and austenite is less than 1.0 μm.

Note that if ferrite is contained in the second phase, the fracture toughness can be improved, if austenite is contained in the second phase, the uniform elongation can be improved, and if martensite is contained in the second phase, the strength can be increased. There is a case where, other than ferrite, martensite and austenite, cementite and perlite are inevitably contained in the second phase other than bainite being the main phase, and such an inevitable structure is allowed to be contained if the structure is 5 area % or less.

(4) Average Nanohardness of Bainite: Not Less than 4.0 GPa Nor More than 5.0 GPa If an average nanohardness of bainite is less than 4.0 GPa, it becomes difficult to secure a tensile strength of 980 MPa or more in a steel material in which the area ratio of bainite is 80% or more. Therefore, the average nanohardness of bainite is set to 4.0 GPa or more. On the other hand, if the average nanohardness of bainite exceeds 5.0 GPa, it becomes difficult to suppress the occurrence of crack when applying the impact load. Therefore, the average nanohardness of bainite is set to 5.0 GPa or less.

Here, the nanohardness is a value obtained by measuring a nanohardness in a bainite block by using a nanoindentation. In the present invention, a cube corner indenter is used, and a nanohardness obtained under an indentation load of 500 μN is adopted.

(5) Average Grain Spacing of MX-Type Carbides Each Having Circle-Equivalent Diameter of 10 nm or More: 300 nm or Less In the steel material containing bainite as the main phase, a precipitation site of the second phase is a prior austenite grain boundary, and in order to refine the second phase, it is necessary to refine austenite grains. As a result of studying various methods for refining austenite grains, it was clarified that by employing suitable hot-rolling conditions and heat treatment conditions to obtain a pinning effect provided by MX-type carbides, a growth of coarse crystal grains can be greatly suppressed, as will be described later.

The MX-type carbide is a carbide having a NaCl-type crystal structure, and is formed of V and/or Ti and C. A size of the MX-type carbide exhibiting the pinning effect is 10 nm or more in a circle-equivalent diameter. If the size of the MX-type carbide is less than 10 nm in the circle-equivalent diameter, the pining effect with respect to a grain boundary migration cannot be expected. Therefore, the refining of structure is tried to be realized by making the MX-type carbides each having the circle-equivalent diameter of 10 nm or more exist, but, if an average grain spacing between the carbides exceeds 300 nm, it is difficult to achieve a sufficient pinning effect. Therefore, it is set that the MX-type carbides each having the circle-equivalent diameter of 10 nm or more exist with the average grain spacing of 300 nm or less therebetween.

A density of the MX-type carbides each having the circle-equivalent diameter of 10 nm or more is preferably as high as possible, so that a lower limit of the average grain spacing between the carbides is not particularly specified, but, realistically, the lower limit is 50 nm or more. Although an upper limit of the size of the MX carbide is not particularly specified, an excessively coarse size may exert an adverse effect on the ductility, instead of improving the ductility, so that the upper limit of the size of the MX carbide (circle-equivalent diameter) is preferably set to 50 nm.

3. Properties

The steel material according to the present invention has a characteristic in a point that the effective flow stress is high, the impact absorption energy is high, and at the same time, the occurrence of crack when applying the impact load is suppressed. This characteristic is proved based on a high 5% flow stress, a high average crush load, and a high stable buckling ratio in a buckling test, as will be indicated in later-described examples. The 5% flow stress is preferably 700 MPa or more.

As other mechanical properties, there can be cited properties in which the strength is high and the ductility and a hole expandability are excellent, such that the tensile strength is 982 MPa or more, the uniform elongation (total elongation) is 7% or more, and a hole expansion ratio is 120% or more when measured by a measurement method based on Japan Iron and Steel Federation standard JFST 1001-1996.

4. Manufacturing Method

The steel material of the present invention can be obtained through the following manufacturing methods (1) to (3), for example.

Manufacturing Method (1): Hot-Rolled Material (No Performance of Heat Treatment)

In order to obtain the steel material of the present invention as hot-rolled, it is preferable to properly precipitate VC and TiC in a hot-rolling step to suppress a growth of coarse crystal grains with the use of the pinning effect provided by VC and TiC, and to optimize a multi-phase structure by controlling a thermal history.

First, a slab having the above-described chemical composition is set to have a temperature of 1200° C. or more and subjected to multi-pass rolling at a total reduction ratio of 50% or more, and the rolling is completed in a temperature region of not less than 800° C. nor more than 950° C. Within a period of time of 0.4 seconds after the completion of the rolling, the resultant is cooled at a cooling rate of 600° C./second or more to a temperature region of 500° C. or less, and coiled in a temperature region of not less than 300° C. nor more than 500° C., to thereby produce a hot-rolled steel sheet.

Through the above-described hot rolling and cooling, it is possible to obtain a steel structure as hot-rolled, having the MX-type carbides dispersed therein, and mainly formed of a bainite structure with a fine block size.

When the above-described hot-rolling conditions are not satisfied, there is a case where an intended steel structure cannot be obtained and the ductility and the strength are lowered, since austenite becomes coarse, and besides, a precipitation density of the MX-type carbides is decreased. Further, when the above-described cooling conditions are not satisfied, there is a case where the generation of ferrite in the cooling step becomes excessive, and besides, the block size of bainite becomes too large, resulting in that desired impact properties cannot be achieved.

In this manufacturing method (1), after the hot rolling is practically completed, rapid cooling is conducted at a cooling rate of 600° C./second or more to a temperature region of 500° C. or less within a period of time of 0.4 seconds. The practical completion of hot rolling means a pass in which the practical rolling is conducted at last, in the rolling of plurality of passes conducted in finish rolling of the hot rolling. For example, in a case where the practical final reduction is conducted in a pass on an upstream side of a finishing mill, and the practical rolling is not conducted in a pass on a downstream side of the finishing mill, the rapid cooling is conducted to the temperature region of 500° C. or less within a period of time of 0.4 seconds after the rolling in the pass on the upstream side is completed. Further, for example, in a case where the practical rolling is conducted up to when the pass reaches the pass on the downstream side of the finishing mill, the rapid cooling is conducted to the temperature region of 500° C. or less within a period of time of 0.4 seconds after the rolling in the pass on the downstream side is completed. Note that the rapid cooling is basically conducted by a cooling nozzle disposed on a run-out-table, but, it is also possible to be conducted by an inter-stand cooling nozzle disposed between the respective passes of the finishing mill.

The above-described cooling rate (600° C./second or more) is set based on a temperature of a surface of sample (surface temperature of steel sheet) measured by a thermotracer. A cooling rate (average cooling rate) of the entire steel sheet is estimated to be about 200° C./second or more, as a result of conversion from the cooling rate (600° C./second or more) based on the surface temperature.

Manufacturing Method (2): Hot-Rolled and Heat-Treated Material

In order to obtain the steel material of the present invention by performing heat treatment after hot rolling, it is preferable that VC and TiC are properly precipitated in a hot-rolling step and a temperature-raising process in a heat treatment step, a growth of coarse crystal grains is suppressed by a pinning effect provided by VC and TiC, and an optimization of multi-phase structure is realized during the heat treatment.

First, a slab having the above-described chemical composition is set to have a temperature of 1200° C. or more and subjected to multi-pass rolling at a total reduction ratio of 50% or more, and the rolling is completed in a temperature region of not less than 800° C. nor more than 950° C. Within a period of time of 0.4 seconds after the completion of the rolling, the resultant is cooled at a cooling rate of 600° C./second or more to a temperature region of 700° C. or less (this cooling is also referred to as primary cooling), and then cooled to a temperature region of 500° C. or less at a cooling rate of less than 100° C./second (this cooling is also referred to as secondary cooling), and after that, the resultant is coiled in a temperature region of not less than 300° C. nor more than 500° C., to thereby produce a hot-rolled steel sheet.

By this hot-rolling step, the hot-rolled steel sheet in which the MX-type carbides are precipitated at high density in the ferrite grain boundary, is obtained. On the other hand, when the above-described hot-rolling conditions are not satisfied, it becomes difficult to obtain the steel material of the present invention since the average grain diameter of the MX-type carbides becomes too small and the pinning effect with respect to the grain growth is reduced, and an average intergranular distance of the MX-type carbides becomes too large, which does not contribute to the refining of crystal grains.

In this manufacturing method (2), after the hot rolling is practically completed, rapid cooling is conducted at a cooling rate of 600° C./second or more to a temperature region of 700° C. or less within a period of time of 0.4 seconds. Similar to the previously described manufacturing method (1), also in the manufacturing method (2), the practical completion of hot rolling means a pass in which the practical rolling is conducted at last, in the rolling of plurality of passes conducted in finish rolling of the hot rolling. The rapid cooling is basically conducted by a cooling nozzle disposed on a run-out-table, but, it is also possible to be conducted by an inter-stand cooling nozzle disposed between the respective passes of the finishing mill.

The above-described cooling rate (600° C./second or more) is set based on a temperature of a surface of sample (surface temperature of steel sheet) measured by a thermotracer. A cooling rate (average cooling rate) of the entire steel sheet is estimated to be about 200° C./second or more, as a result of conversion from the cooling rate (600° C./second or more) based on the surface temperature.

In this manufacturing method (2), next, a temperature of the hot-rolled steel sheet obtained by the above-described hot-rolling step is raised to a temperature region of not less than 850° C. nor more than 920° C. at an average temperature rising rate of not less than 2° C./second nor more than 50° C./second, and the steel sheet is retained in the temperature region for a period of time of not less than 100 seconds nor more than 300 seconds (annealing in FIG. 1). Subsequently, heat treatment in which the resultant is cooled to a temperature region of not less than 270° C. nor more than 390° C. at an average cooling rate of not less than 10° C./second nor more than 50° C./second, and retained in the temperature region for a period of time of not less than 10 seconds nor more than 300 seconds, is performed (quenching in FIG. 1).

If the above-described average temperature rising rate is less than 2° C./second, the grain growth of ferrite occurs during the temperature rising, resulting in that the crystal grains become coarse. Although the above-described average temperature rising rate is preferably as high as possible, realistically, it is 50° C./second or less. If the temperature retained after the above-described temperature rising is less than 850° C. or the retention time is less than 100 seconds, an austenitize required for the quenching becomes insufficient, resulting in that it becomes difficult to obtain an intended multi-phase structure. On the other hand, if the temperature retained after the above-described temperature rising exceeds 920° C. or the retention time exceeds 300 seconds, austenite becomes coarse, resulting in that it becomes difficult to obtain an intended multi-phase structure.

After the above-described temperature rising, in order to obtain a structure mainly formed of bainite, it is necessary to perform quenching at a bainite transformation temperature or less while suppressing a ferrite transformation. If the above-described average cooling rate is less than 10° C./second, a ferrite amount becomes excessive, and it is difficult to obtain a sufficient strength. Although the above-described average cooling rate is preferably as high as possible, realistically, it is 50° C./second or less. Further, if a cooling stop temperature of the cooling described above is less than 270° C., an area ratio of martensite becomes too large, resulting in that the local ductility is lowered. On the other hand, if the cooling stop temperature of the cooling described above exceeds 390° C., the average block size of bainite becomes coarse, resulting in that the strength and the ductility are lowered. Further, if the retention time in the temperature region of not less than 270° C. nor more than 390° C. is less than 10 seconds, the facilitation of bainite transformation sometimes becomes insufficient. On the other hand, if the retention time in the temperature region of not less than 270° C. nor more than 390° C. exceeds 300 seconds, the productivity is significantly hindered.

It is also possible to adjust a hardness of bainite by conducting, after the above-described quenching, tempering treatment according to need in which a retention is performed in a temperature region of not less than 400° C. nor more than 550° C. for a period of time of not less than 10 seconds nor more than 650 seconds (tempering 1 and tempering 2 in FIG. 1). Note that the tempering may be performed in one stage, or may also be performed in a plurality of stages separately. FIG. 1 illustrates an example in which the tempering is performed in two stages separately.

Here, if the tempering temperature is less than 400° C. or the tempering time is less than 10 seconds, it is not possible to sufficiently achieve an effect provided by the tempering. On the other hand, if the tempering temperature exceeds 550° C. or the tempering time exceeds 650 seconds, there is a case where an intended strength cannot be obtained due to the decrease in strength. The tempering can be conducted through heating in two stages or more within the above-described temperature region. In that case, it is preferable that a heating temperature in the first stage is set to be lower than a heating temperature in the second stage.

Manufacturing Method (3): Cold-Rolled and Heat-Treated Material

In order to obtain the steel material of the present invention by performing heat treatment after hot rolling and cold rolling, it is preferable that VC and TiC are properly precipitated in a hot-rolling step and a temperature-raising process in a heat treatment step, a growth of coarse crystal grains is suppressed by a pinning effect provided by VC and TiC, and an optimization of multi-phase structure is realized during the heat treatment, similar to the manufacturing method (2). In order to achieve the above, it is preferable to perform manufacture through a manufacturing method including the following steps.

First, a slab having the above-described chemical composition is set to have a temperature of 1200° C. or more and subjected to multi-pass rolling at a total reduction ratio of 50% or more, and the rolling is completed in a temperature region of not less than 800° C. nor more than 950° C. Within a period of time of 0.4 seconds after the completion of the rolling, the resultant is cooled at a cooling rate of 600°

C./second or more to a temperature region of 700° C. or less (this cooling is also referred to as primary cooling), and then cooled to a temperature region of 500° C. or less at a cooling rate of less than 100° C./second (this cooling is also referred to as secondary cooling), and after that, the resultant is coiled in a temperature region of not less than 300° C. nor more than 500° C., to thereby produce a hot-rolled steel sheet.

By this hot-rolling step, the hot-rolled steel sheet in which the MX-type carbides are precipitated at high density in the ferrite grain boundary, is obtained. On the other hand, when the above-described hot-rolling conditions are not satisfied, it becomes difficult to obtain the steel material of the present invention since the average grain diameter of the MX-type carbides becomes too small and the pinning effect with respect to the grain growth is reduced, and an average intergranular distance of the MX-type carbides becomes too large, which does not contribute to the refining of crystal grains.

In this manufacturing method (3), after the hot rolling is practically completed, rapid cooling is conducted at a cooling rate of 600° C./second or more to a temperature region of 700° C. or less within a period of time of 0.4 seconds. Similar to the previously described manufacturing methods (1) and (2), also in the manufacturing method (3), the practical completion of hot rolling means a pass in which the practical rolling is conducted at last, in the rolling of plurality of passes conducted in finish rolling of the hot rolling. The rapid cooling is basically conducted by a cooling nozzle disposed on a run-out-table, but, it is also possible to be conducted by an inter-stand cooling nozzle disposed between the respective passes of the finishing mill.

The above-described cooling rate (600° C./second or more) is set based on a temperature of a surface of sample (surface temperature of steel sheet) measured by a thermotracer. A cooling rate (average cooling rate) of the entire steel sheet is estimated to be about 200° C./second or more, as a result of conversion from the cooling rate (600° C./second or more) based on the surface temperature.

In this manufacturing method (3), next, cold rolling at a reduction ratio of not less than 30% nor more than 70% is conducted to produce a cold-rolled steel sheet.

Next, a temperature of the cold-rolled steel sheet obtained by the above-described cold-rolling step is raised to a temperature region of not less than 850° C. nor more than 920° C. at an average temperature rising rate of not less than 2° C./second nor more than 50° C./second, and the steel sheet is retained in the temperature region for a period of time of not less than 100 seconds nor more than 300 seconds (annealing in FIG. 1). Subsequently, heat treatment in which the resultant is cooled to a temperature region of not less than 270° C. nor more than 390° C. at an average cooling rate of not less than 10° C./second nor more than 50° C./second, and retained in the temperature region for a period of time of not less than 10 seconds nor more than 300 seconds, is performed (quenching in FIG. 1).

If the above-described average temperature rising rate is less than 2° C./second, the grain growth of ferrite occurs during the temperature rising, resulting in that the crystal grains become coarse. Although the above-described average temperature rising rate is preferably as high as possible, realistically, it is 50° C./second or less. If the temperature retained after the above-described temperature rising is less than 850° C. or the retention time is less than 100 seconds, an austenitize required for the quenching becomes insufficient, resulting in that it becomes difficult to obtain an intended multi-phase structure. On the other hand, if the temperature retained after the above-described temperature rising exceeds 920° C. or the retention time exceeds 300 seconds, austenite becomes coarse, resulting in that it becomes difficult to obtain an intended multi-phase structure.

After the above-described temperature rising, in order to obtain a structure mainly formed of bainite, it is necessary to perform quenching at a bainite transformation temperature or less while suppressing a ferrite transformation. If the above-described average cooling rate is less than 10° C./second, a ferrite amount becomes excessive, and it is difficult to obtain a sufficient strength. Although the above-described average cooling rate is preferably as high as possible, realistically, it is 50° C./second or less. Further, if a cooling stop temperature of the cooling described above is less than 270° C., an area ratio of martensite becomes too large, resulting in that the local ductility is lowered. On the other hand, if the cooling stop temperature of the cooling described above exceeds 390° C., the average block size of bainite becomes coarse, resulting in that the strength and the ductility are lowered. Further, if the retention time in the temperature region of not less than 270° C. nor more than 390° C. is less than 10 seconds, the facilitation of bainite transformation sometimes becomes insufficient. On the other hand, if the retention time in the temperature region of not less than 270° C. nor more than 390° C. exceeds 300 seconds, the productivity is significantly hindered.

It is also possible to adjust a hardness of bainite by conducting, after the above-described quenching, tempering treatment according to need in which a retention is performed in a temperature region of not less than 400° C. nor more than 550° C. for a period of time of not less than 10 seconds nor more than 650 seconds, similar to the previously described manufacturing method (2). Here, if the tempering temperature is less than 400° C. or the tempering time is less than 10 seconds, it is not possible to sufficiently achieve an effect provided by the tempering. On the other hand, if the tempering temperature exceeds 550° C. or the tempering time exceeds 650 seconds, there is a case where an intended strength cannot be obtained due to the decrease in strength. The tempering can be conducted through heating in two stages or more within the above-described temperature region. In that case, it is preferable that a heating temperature in the first stage is set to be lower than a heating temperature in the second stage.

The hot-rolled steel sheet or the cold-rolled steel sheet manufactured through the manufacturing methods (1) to (3) as above may be used as it is as the steel material of the present invention, or a steel sheet, cut from the hot-rolled steel sheet or the cold-rolled steel sheet, on which appropriate working such as bending and presswork is performed according to need, may also be employed as the steel material of the present invention. Further, the steel material of the present invention may also be the steel sheet as it is, or the steel sheet on which plating is performed after the working. The plating may be either electroplating or hot dipping, and although there is no limitation in a type of plating, the type of plating is normally zinc or zinc alloy plating.

EXAMPLES

An experiment was conducted by using slabs (each having a thickness of 35 mm, a width of 160 to 250 mm, and a length of 70 to 140 mm) having chemical compositions presented in Table 1. In Table 1, "–" means that the element is not contained positively. An underline indicates that a value is out of the range of the present invention. A steel type D is a comparative example in which a total content of V and Ti is less than the lower limit value. A steel type I is a comparative example in which a content of Mn exceeds the upper limit value. A steel type J is a comparative example in which a content of C exceeds the upper limit value. In each of the steel types, a molten steel of 150 kg was produced in vacuum to be cast, the resultant was then heated at a furnace temperature of 1250° C., and subjected to hot forging at a temperature of 950° C. or more, to thereby obtain a slab.

TABLE 1

| STEEL | CHEMICAL COMPOSITION (UNIT: MASS %, BALANCE: Fe AND IMPURITIES) | | | | | | | | | | |
|---|---|---|---|---|---|---|---|---|---|---|---|
| TYPE | C | Si | Mn | P | S | Cr | Mo | V | Ti | Al | N |
| A | 0.12 | 1.24 | 2.05 | 0.008 | 0.002 | 0.12 | — | 0.20 | 0.005 | 0.033 | 0.0024 |
| B | 0.12 | 1.23 | 2.01 | 0.009 | 0.002 | 0.20 | 0.20 | 0.15 | 0.005 | 0.030 | 0.0025 |
| C | 0.12 | 1.25 | 2.01 | 0.009 | 0.002 | 0.15 | — | 0.05 | 0.005 | 0.032 | 0.0026 |
| D | 0.12 | 1.23 | 2.25 | 0.011 | 0.002 | 0.10 | — | — | — | 0.035 | 0.0045 |
| E | 0.12 | 1.48 | 2.02 | 0.013 | 0.003 | 0.10 | — | 0.25 | 0.005 | 0.033 | 0.0025 |
| F | 0.18 | 1.25 | 2.20 | 0.010 | 0.003 | — | — | 0.20 | 0.003 | 0.051 | 0.0031 |
| G | 0.15 | 1.30 | 2.02 | 0.012 | 0.002 | 0.10 | — | 0.25 | — | 0.035 | 0.0024 |
| H | 0.18 | 1.33 | 2.20 | 0.010 | 0.002 | 0.10 | 0.22 | — | 0.012 | 0.35 | 0.0025 |
| I | 0.15 | 1.52 | 3.5 | 0.012 | 0.002 | 0.15 | — | 0.20 | 0.004 | 0.035 | 0.0035 |
| J | 0.22 | 1.32 | 2.15 | 0.010 | 0.002 | 0.15 | — | — | 0.005 | 0.025 | 0.0032 |

UNDERLINE INDICATES THAT VALUE IS OUT OF RANGE OF PRESENT INVENTION

Each of the above-described slabs was reheated at 1250° C. within 1 hour, and after that, the resultant was subjected to rough hot rolling in 4 passes by using a hot-rolling testing machine, the resultant was further subjected to finish hot rolling in 3 passes, and after the completion of rolling, primary cooling and secondary cooling were conducted, to thereby obtain a hot-rolled steel sheet. Hot-rolling conditions are presented in Table 2. The primary cooling and the secondary cooling right after the completion of rolling were conducted by water cooling. The secondary cooling was completed at a coiling temperature presented in Table.

TABLE 2

| | | HOT ROLLING | | | | PRIMARY COOLING | |
|---|---|---|---|---|---|---|---|
| | | ROUGH ROLLING | FINISH HOT ROLLING | | | | |
| TEST NUMBER | STEEL TYPE | TOTAL REDUCTION RATIO (%) | NUMBER OF PASSES | REDUCTION RATIO IN EACH PASS | ROLLING COMPLETION TEMPERATURE (° C.) | AVERAGE COOLING RATE (° C./s) | COOLING STOP TEMPERATURE (° C.) |
| 1 | A | 83 | 3 | 30%-30%-30% | 900 | >1000 | 450 |
| 2 | A | 83 | 3 | 30%-30%-30% | 900 | >1000 | 450 |
| 3 | A | 83 | 3 | 30%-30%-30% | 900 | >1000 | 650 |
| 4 | A | 83 | 3 | 30%-30%-30% | 900 | >1000 | 650 |
| 5 | A | 83 | 3 | 30%-30%-30% | 900 | >1000 | 650 |
| 6 | B | 83 | 3 | 30%-30%-30% | 900 | >1000 | 450 |
| 7 | C | 83 | 3 | 30%-30%-30% | 900 | >1000 | 650 |
| 8 | D | 83 | 3 | 30%-30%-30% | 900 | >1000 | 650 |
| 9 | E | 83 | 3 | 30%-30%-30% | 900 | >1000 | 650 |
| 10 | E | 83 | 3 | 30%-30%-30% | 900 | >1000 | 650 |
| 11 | E | 83 | 3 | 30%-30%-30% | 900 | >1000 | 650 |
| 12 | E | 83 | 3 | 30%-30%-30% | 900 | >1000 | 650 |
| 13 | F | 83 | 3 | 30%-30%-30% | 820 | >1000 | 650 |
| 14 | G | 83 | 3 | 30%-30%-30% | 820 | >1000 | 650 |
| 15 | H | 83 | 3 | 30%-30%-30% | 820 | >1000 | 650 |
| 16 | I | 83 | 3 | 30%-30%-30% | 900 | >1000 | 650 |
| 17 | J | 83 | 3 | 30%-30%-30% | 820 | >1000 | 650 |

TABLE 2-continued

| TEST NUMBER | PRIMARY COOLING PERIOD OF TIME FROM COMPLETION OF ROLLING TO START OF COOLING (s) | SECONDARY COOLING AVERAGE COOLING RATE (° C./s) | SECONDARY COOLING COOLING STOP TEMPERATURE (° C.) | SECONDARY COOLING COILING TEMPERATURE (° C.) | SHEET THICKNESS OF HOT-ROLLED STEEL SHEET (nm) |
|---|---|---|---|---|---|
| 1 | 0.1 | — | — | 450 | 1.6 |
| 2 | 1.2 | — | — | 450 | 1.6 |
| 3 | 0.1 | 17 | 415 | 400 | 3.2 |
| 4 | 0.1 | 15 | 460 | 450 | 3.2 |
| 5 | 1.2 | 10 | 450 | 450 | 3.2 |
| 6 | 0.1 | — | — | 450 | 1.6 |
| 7 | 0.1 | 17 | 417 | 400 | 3.2 |
| 8 | 0.1 | 16 | 420 | 400 | 3.2 |
| 9 | 0.1 | 17 | 420 | 400 | 3.2 |
| 10 | 0.1 | 15 | 455 | 450 | 3.2 |
| 11 | 0.1 | 16 | 460 | 450 | 3.2 |
| 12 | 0.1 | 16 | 455 | 450 | 3.2 |
| 13 | 0.1 | 19 | 430 | 400 | 1.6 |
| 14 | 0.1 | 19 | 450 | 400 | 3.2 |
| 15 | 0.1 | 19 | 410 | 400 | 1.6 |
| 16 | 0.1 | 16 | 460 | 420 | 1.6 |
| 17 | 0.1 | 19 | 410 | 400 | 1.6 |

UNDERLINE INDICATES THAT VALUE IS OUT OF RANGE OF PRESENT INVENTION

The steel sheets of test numbers 1, 2, 6, 13, and 15 to 17 were set to be steel sheets as hot-rolled, without performing cold rolling. On the other steel sheets of test numbers 3 to 5, 7 to 12, and 14, the cold rolling was performed. As can be understood from Table 2 and Table 3, a sheet thickness of each of the obtained hot-rolled steel sheets or cold-rolled steel sheets was 1.6 mm. On the steel sheets of test numbers 4, 5, 9 to 12, and 14, heat treatment was performed by using a continuous annealing simulator with a heat pattern presented in FIG. 1 and under conditions presented in Table 3. In the present examples, a process from a temperature rising to a temperature retention in the heat treatment corresponds to annealing, cooling after the annealing corresponds to quenching, and heat treatment thereafter corresponds to tempering conducted for the purpose of performing hardness adjustment (softening). As can be understood from FIG. 1 and Table 3, the tempering heat treatment in the temperature region of not less than 400° C. nor more than 550° C. was conducted in two stages. Note that on the steel sheets of test numbers 3, 7, 8, and 13, only the quenching was performed after the annealing, and the tempering was not performed.

TABLE 3

| TEST NUMBER | STEEL TYPE | TOTAL REDUCTION RATIO IN COLD ROLLING | CONDITIONS OF CONTINUOUS ANNEALING: CONDITIONS OF ANNEALING: TEMPERATURE RISING RATE (° C./s) | CONDITIONS OF ANNEALING: ANNEALING TEMPERATURE (° C.) | CONDITIONS OF ANNEALING: ANNEALING TIME (s) | CONDITIONS OF ANNEALING: COOLING RATE (° C./s) | CONDITIONS FROM QUENCHING TO TEMPERING (① TO ②) QUENCHING TEMPERATURE (° C.) |
|---|---|---|---|---|---|---|---|
| 1 | A | AS HOT-ROLLED | — | — | — | — | — |
| 2 | A | AS HOT-ROLLED | — | — | — | — | — |
| 3 | A | 50% | 10 | 900 | 250 | 40 | 330 |
| 4 | A | 50% | 10 | 900 | 250 | 40 | 330 |
| 5 | A | 50% | 10 | 900 | 250 | 40 | 330 |
| 6 | B | AS HOT-ROLLED | — | — | — | — | — |
| 7 | C | 50% | 10 | 920 | 250 | 35 | 310 |
| 8 | D | 50% | 10 | 920 | 250 | 35 | 330 |
| 9 | E | 50% | 10 | 900 | 250 | 40 | 330 |
| 10 | E | 50% | 10 | 850 | 250 | 40 | 330 |
| 11 | E | 50% | 10 | 850 | 120 | 40 | 25 |
| 12 | E | 50% | 20 | 900 | 120 | 5 | 330 |
| 13 | F | AS HOT-ROLLED | 10 | 850 | 250 | 40 | 330 |
| 14 | G | 50% | 10 | 900 | 250 | 40 | 330 |
| 15 | H | AS HOT-ROLLED | — | — | — | — | — |
| 16 | I | AS HOT-ROLLED | — | — | — | — | — |
| 17 | J | AS HOT-ROLLED | — | — | — | — | — |

TABLE 3-continued

| TEST NUMBER | CONDITIONS OF CONTINUOUS ANNEALING CONDITIONS FROM QUENCHING TO TEMPERING (① TO ②) QUENCHING TIME (s) | TEMPERING TEMPERATURE ① (° C.) | TEMPERING TIME ① (s) | TEMPERING TEMPERATURE ② (° C.) | TEMPERING TIME ② (s) |
|---|---|---|---|---|---|
| 1 | — | — | — | — | — |
| 2 | — | — | — | — | — |
| 3 | 120 | — | — | — | — |
| 4 | 120 | 460 | 60 | 340 | 14 |
| 5 | 120 | 460 | 12 | 340 | 14 |
| 6 | — | — | — | — | — |
| 7 | 120 | — | — | — | — |
| 8 | 120 | — | — | — | — |
| 9 | 120 | 460 | 12 | 540 | 14 |
| 10 | 120 | 460 | 400 | 540 | 14 |
| 11 | 600 | 400 | 120 | 520 | 350 |
| 12 | 120 | 400 | 12 | 540 | 14 |
| 13 | 120 | — | — | — | — |
| 14 | 120 | 460 | 12 | 220 | 14 |
| 15 | — | — | — | — | — |
| 16 | — | — | — | — | — |
| 17 | — | — | — | — | — |

UNDERLINE INDICATES THAT VALUE IS OUT OF RANGE OF PRESENT INVENTION

Regarding the hot-rolled steel sheets and the cold-rolled steel sheets obtained as above, the following examination was conducted.

First, a JIS No. 5 tensile test piece was collected from a test steel sheet in a direction perpendicular to a rolling direction, and subjected to a tensile test, thereby determining a 5% flow stress, a maximum tensile strength (TS), and a uniform elongation (u-E1). The 5% flow stress indicates a stress when a plastic deformation occurs in which a strain becomes 5% in the tensile test, the 5% flow stress has a proportionality relation with the effective flow stress, and becomes an index of the effective flow stress.

A hole expansion test was conducted to determine a hole expansion ratio based on Japan Iron and Steel Federation standard JFST 1001-1996 except that reamer working was performed on a machined hole to remove an influence of a damage of end face.

The EBSD analysis was conducted at a position of ¼ depth in a sheet thickness of a cross section parallel to a rolling direction of the steel sheet, in which an average grain diameter of a main phase and a second phase was determined, and a grain boundary surface misorientation map was created. Regarding a block size of bainite, a unit of structure surrounded by an interface where a misorientation was 15° or more was assumed to be a bainite block, and an average block size was determined by averaging circle-equivalent diameters of the bainite blocks.

A nanohardness of bainite was determined by a nanoindentation method. A section test piece collected in a direction parallel to the rolling direction at a position of ¼ depth in a sheet thickness was polished by an emery paper, the resultant was subjected to mechanochemical polishing using colloidal silica, and then further subjected to electrolytic polishing to remove a worked layer, and then the resultant was subjected to a test. The nanoindentation was carried out by using a cube corner indenter under an indentation load of 500 μN. An indentation size at this time is a diameter of 0.5 μm or less. The hardness of bainite of each sample was measured at randomly-selected 20 points, and an average nanohardness of each sample was determined.

In the second phase, an austenite phase was discriminated based on an analysis of crystal system using the EBSD. Further, a pro-eutectoid ferrite phase and a martensite phase were separated based on a hardness measured by a nanoindentation. Specifically, a phase with a nanohardness of less than 4 GPa was set to the pro-eutectoid ferrite phase, and meanwhile, a phase with a nanohardness of 6 GPa or more was set to the martensite phase, and based on a two-dimensional image obtained by an atomic force microscope installed side by side with a nanoindentation device, a total area ratio and an average grain diameter of these ferrite phase, martensite phase and austenite phase were determined.

The MX-type carbide was identified by a TEM observation using an extraction replica sample, and an average grain spacing of the MX-type carbides each having an average grain diameter of 10 nm or more was calculated from a two-dimensional image of a TEM bright-field image.

Further, an angular tube member was produced by using each of the above-described steel sheets, and an axial crush test was conducted at a collision speed in an axial direction of 64 km/h, to thereby evaluate a collision absorbency. A shape of a cross section perpendicular to the axial direction of the angular tube member was set to an equilateral octagon, and a length in the axial direction of the angular tube member was set to 200 mm. The evaluation was conducted under a condition where each member was set to have a sheet thickness of 1.6 mm, and a length of one side of the above-described equilateral octagon (length of straight portion except for curved portion of corner portion) (Wp) of 25.6 mm Two of such angular tube members were produced from each of the steel sheets, and subjected to the axial crush test. The evaluation was conducted based on an average load when the axial crush occurred (average value of two times of test) and a stable bucking ratio. The stable buckling ratio corresponds to a proportion of a number of test bodies in which no crack occurred in the axial crush test, with respect to a number of all test bodies. Generally, the possibility in which the crack occurs in the middle of the crush is increased when an impact absorption energy is increased, resulting in that a plastic deformation workload cannot be increased, and there is a case where the impact absorption energy cannot be increased. Specifically, no matter how high the average crush load (impact absorbency) is, it is not possible to exhibit a high impact absorbency unless the stable buckling ratio is good.

Results of the examination described above (steel structure, mechanical properties, and axial crush properties) are collectively presented in Table 4.

TABLE 4

| TEST NUMBER | STEEL TYPE | STEEL STRUCTURE: AREA RATIO OF BAINITE (%) | AVERAGE BLOCK SIZE OF BAINITE (μm) | AVERAGE NANO HARDNESS OF BAINITE (Gpa) | TOTAL AREA RATIO OF FERRITE, MARTENSITE, AND AUSTENITE (%) | AVERAGE GRAIN DIAMETER OF FERRITE, MARTENSITE, AND AUSTENITE (μm) | AVERAGE GRAIN SPACING OF MX-TYPE CARBIDES EACH HAVING GRAIN DIAMETER OF 10 nm: OR MORE (nm) |
|---|---|---|---|---|---|---|---|
| 1 | A | 93 | 1.2 | 4.3 | 7 | 0.7 | 198 |
| 2 | A | 92 | 3.5 | 3.3 | 5 | 2.5 | 324 |
| 3 | A | 93 | 1.4 | 4.3 | 7 | 0.6 | 186 |
| 4 | A | 92 | 1.3 | 4.2 | 8 | 0.5 | 195 |
| 5 | A | 85 | 2.8 | 3.8 | 15 | 3.7 | 333 |
| 6 | B | 91 | 1.1 | 4.6 | 9 | 0.7 | 273 |
| 7 | C | 92 | 1.2 | 4.1 | 8 | 0.7 | 292 |
| 8 | D | 73 | 4.5 | 3.6 | 27 | 4.2 | — |
| 9 | E | 94 | 1.4 | 4.4 | 6 | 0.8 | 163 |
| 10 | E | 75 | 7.2 | 3.9 | 25 | 0.6 | 165 |
| 11 | E | 0 | — | — | 100 | 5.6 | 162 |
| 12 | E | <50 | 2.8 | 3.8 | 55 | 3.5 | 175 |
| 13 | F | 91 | 1.9 | 4.2 | 9 | 0.8 | 175 |
| 14 | G | 92 | 1.3 | 4.5 | 8 | 0.7 | 170 |
| 15 | H | 93 | 1.6 | 4.7 | 7 | 0.9 | 165 |
| 16 | I | 0 | — | — | 100 | 3.6 | — |
| 17 | J | 0 | — | — | 100 | 5.6 | — |

| TEST NUMBER | TENSILE AND HOLE EXPANSION PROPERTIES: 5% FLOW STRESS (MPa) | MAXIMUM TENSILE STRESS (MPa) | UNIFORM ELONGATION (%) | HOLE EXPANSION RATIO (%) | AXIAL CRUSH PROPERTIES: AVERAGE CRUSH LOAD ($kN/mm^2$) | STABLE BUCKLING RATIO | CLASSIFICATION |
|---|---|---|---|---|---|---|---|
| 1 | 812 | 1061 | 11.5 | 122 | 0.40 | 2/2 | INVENTION EXAMPLE |
| 2 | 450 | 1065 | 13.2 | 89 | 0.32 | 1/2 | COMPARATIVE EXAMPLE |
| 3 | 855 | 1160 | 7.4 | 136 | 0.40 | 2/2 | INVENTION EXAMPLE |
| 4 | 888 | 1052 | 9.8 | 145 | 0.40 | 2/2 | INVENTION EXAMPLE |
| 5 | 651 | 1111 | 7.8 | 64 | 0.31 | 0/2 | COMPARATIVE EXAMPLE |
| 6 | 745 | 1012 | 9.8 | 136 | 0.39 | 2/2 | INVENTION EXAMPLE |
| 7 | 785 | 1016 | 11.9 | 136 | 0.36 | 2/2 | INVENTION EXAMPLE |
| 8 | 523 | 1045 | 12.8 | 88 | 0.33 | 0/2 | COMPARATIVE EXAMPLE |
| 9 | 910 | 1058 | 10.3 | 151 | 0.43 | 2/2 | INVENTION EXAMPLE |
| 10 | 915 | 999 | 10.5 | 153 | 0.38 | 1/2 | COMPARATIVE EXAMPLE |
| 11 | 410 | 1253 | 5.4 | 35 | — | 0/2 | COMPARATIVE EXAMPLE |
| 12 | 435 | 875 | 11.5 | 45 | — | 0/2 | COMPARATIVE EXAMPLE |
| 13 | 772 | 999 | 11.8 | 161 | 0.39 | 2/2 | INVENTION EXAMPLE |
| 14 | 890 | 1023 | 11.5 | 143 | 0.41 | 2/2 | INVENTION EXAMPLE |
| 15 | 915 | 1067 | 11.3 | 135 | 0.43 | 2/2 | INVENTION EXAMPLE |
| 16 | 1016 | 1012 | 2.5 | 10 | — | 0/2 | COMPARATIVE EXAMPLE |
| 17 | 1123 | 1130 | 0.5 | — | — | 0/2 | COMPARATIVE EXAMPLE |

UNDERLINE INDICATES THAT VALUE IS OUT OF RANGE OF PRESENT INVENTION

As can be understood from Table 4, in the steel material related to the present invention, the average load when the axial crush occurs is high to be 0.38 $kN/mm^2$ or more. Further, a good axial crush property is exhibited such that the stable buckling ratio is 2/2. Further, a high strength is provided since the tensile strength is 980 MPa or more, both of the hole expansion ratio and the 5% flow stress are high to be 122% or more and 745 MPa or more, respectively, and a value of the ductility is also sufficiently high. Therefore, the steel material related to the present invention is suitably used as a material of the above-described crush box, a side member, a center pillar, a rocker and the like.

The invention claimed is:

1. A steel material, comprising: by mass %,

C: greater than 0.05% to 0.18%;

Mn: 1% to 3%;

Si: greater than 0.5% to 1.8%;

Al: 0.01% to 0.5%;

N: 0.001% to 0.015%;

one or both of V and Ti: 0.01% to 0.3% in total;

Cr: 0% to 0.25%;

Mo: 0% to 0.35%;

a balance: Fe and impurities; and

80% or more of bainite by area %, and 5% or more in total of one or two or more selected from a group consisting of ferrite, martensite and austenite by area %, wherein:

an average block size of the bainite is less than 2.0 μm, and an average grain diameter of all of the ferrite, martensite and austenite is less than 1.0 μm;

an average nanohardness of the bainite is 4.0 GPa to 5.0 GPa; and

MX-type carbides each having a circle-equivalent diameter of 10 nm or more exist with an average grain spacing of 300 nm or less therebetween.

2. The steel material according to claim 1, comprising one or two selected from a group consisting of, by mass %, Cr: 0.05% to 0.25%, and Mo: 0.1% to 0.35%.

3. The steel material according to claim 1, wherein the content of Si is 1.0% to 1.8%.

4. A steel material, consisting of, by mass %:

C: greater than 0.05% to 0.18%;

Mn: 1% to 3%;

Si: greater than 0.5% to 1.8%;

Al: 0.01% to 0.5%;

N: 0.001% to 0.015%;

one or both of V and Ti: 0.01% to 0.3% in total;

Cr: 0% to 0.25%;

Mo: 0% to 0.35%;

P: 0.02% or less;

S: 0.005% or less;

a balance: Fe and impurities; and

80% or more of bainite by area %, and 5% or more in total of one or two or more selected from the group consisting of ferrite, martensite and austenite by area %, wherein:

an average block size of the bainite is less than 2.0 μm, and an average grain diameter of all of the ferrite, martensite and austenite is less than 1.0 μm;

an average nanohardness of the bainite is 4.0 GPa to 5.0 GPa; and

MX-type carbides each having a circle-equivalent diameter of 10 nm or more exist with an average grain spacing of 300 nm or less therebetween.

* * * * *